US008113732B2

(12) United States Patent
Shima et al.

(10) Patent No.: US 8,113,732 B2
(45) Date of Patent: Feb. 14, 2012

(54) DIRECT LIQUID-WRITING INSTRUMENT

(75) Inventors: Takehiko Shima, Tokyo (JP); Masahiko Itakura, Tokyo (JP); Hiromoto Sasaki, Tokyo (JP)

(73) Assignees: Micro Co., Ltd., Tokyo (JP); Daicel Polymer Ltd., Tokyo (JP)

( * ) Notice: Subject to any disclaimer, the term of this patent is extended or adjusted under 35 U.S.C. 154(b) by 917 days.

(21) Appl. No.: 12/157,604

(22) Filed: Jun. 11, 2008

(65) Prior Publication Data

US 2009/0028628 A1 Jan. 29, 2009

(30) Foreign Application Priority Data

Jun. 11, 2007 (JP) ..... 2007-153700

(51) Int. Cl.
*B43K 5/18* (2006.01)
*B43K 5/02* (2006.01)

(52) U.S. Cl. ..... 401/223; 401/224; 401/225; 401/227; 401/229

(58) Field of Classification Search ..... 401/223, 401/224, 225, 227, 229
See application file for complete search history.

(56) References Cited

U.S. PATENT DOCUMENTS

| | | | | |
|---|---|---|---|---|
| 5,944,438 | A * | 8/1999 | Koyama et al. | 401/227 |
| 6,037,391 | A | 3/2000 | Iida | |
| 6,340,259 | B2 * | 1/2002 | Mito et al. | 401/223 |
| 6,409,408 | B2 * | 6/2002 | Koyama | 401/222 |
| 6,517,273 | B2 * | 2/2003 | Koyama et al. | 401/223 |

FOREIGN PATENT DOCUMENTS

| | | | |
|---|---|---|---|
| DE | 199 04 706 | A1 | 8/1999 |
| EP | 1 607 238 | A1 | 12/2005 |
| JP | 05-238186 | A | 9/1993 |
| JP | 08-156481 | | 6/1996 |
| JP | 08-164694 | | 6/1996 |
| JP | 09-315079 | | 12/1997 |
| JP | 11-12526 | | 1/1999 |
| JP | 11-227379 | | 8/1999 |
| JP | 11-268470 | | 10/1999 |
| JP | 2002-192878 | | 7/2002 |
| JP | 2003-266986 | | 9/2003 |
| JP | 2004-224011 | | 8/2004 |
| JP | 2005-88289 | | 4/2005 |

OTHER PUBLICATIONS

European Search Report mailed Dec. 11, 2008 (3 sheets).

* cited by examiner

*Primary Examiner* — David J. Walczak
*Assistant Examiner* — Bradley Oliver
(74) *Attorney, Agent, or Firm* — Flynn, Thiel, Boutell & Tanis, P.C.

(57) ABSTRACT

The present invention provides a direct liquid-writing instrument without ink leakage from the pen-tip even after a long period of use. Specifically, it provides a direct liquid-writing instrument having an ink-retaining part in a bellows-like shape, in which at least the ink-retaining part in a bellows-like shape is made of: 20 to 95% by mass of (A) a polyamide-based resin; and 80 to 5% by mass of (B) at least one resin selected from a styrene-based resin, an olefin-based resin, and a polyphenylene ether resin.

7 Claims, 2 Drawing Sheets

DIRECT LIQUID-WRITING INSTRUMENT

TECHNICAL FIELD

The present invention relates to a resin composition used for direct liquid-writing instruments such as ballpoint and fountain pens, and also to a direct liquid-writing instrument using the same.

BACKGROUND ART

Direct liquid-writing instruments such as ballpoint and fountain pens using a water-ink have, as a component, an ink-retaining part in a bellows-like shape made of a thermoplastic resin such as ABS resin. The ink-retaining part is required to have a good wettability of ink. If the wettability is poor, ink-leakage occurs from the pen-tip during use, which raises problems of getting users' hands dirty or of soiling papers.

JP-A 8-156481 discloses a method for forming a thin film of a surfactant or of a hydrophilic substance on the surface of the ink-retaining member 2, a method for forming an irregular profile on the surface of the ink-retaining member 2 caused by etching treatment, deposits, and the like, and other methods.

JP-A 9-315079 discloses an etching treatment for improving the wettability of a resin part (a pen core 14 including the ink-retaining portion 14b) of the direct liquid-writing instrument, using an etching liquid composed of sulfuric acid as the base compound and, further, of chromic anhydride and phosphoric acid. As described also in JP-A 9-315079, however, the etching liquid has a problem of a strong toxicity.

JP-A 11-268470 discloses a method for applying chemical treatment using an acid such as hydrochloric acid, nitric acid, or a chromic acid mixture, and using an alkali, and the like for improving wettability of resin part (such as a collector (ink-retaining body) 2b which is an adjustor for adjusting the internal pressure of the writing instrument using a plurality of blade-shaped grooves) of the direct liquid-writing instrument.

JP-A 2005-88289 shows a direct liquid-writing instrument having an ink-retaining part formed by a thermoplastic resin having a permanent antistatic, but is not sufficient in prevention of ink-leakage.

DISCLOSURE OF THE INVENTION

The invention provides a resin composition for a part contacting with a water-ink in a direct liquid-writing instrument. With the resin composition, a direct liquid-writing instrument can be manufactured which is free from ink-leakage from a pen-tip, even after a long use, without applying an etching treatment by a toxic chromic acid or other modification treatments.

The invention then provides a direct liquid-writing instrument free from ink-leakage from a pen-tip, even after a long use, without applying an etching treatment by a toxic chromic acid or other modification treatment.

The present invention provides a resin composition for a part contacting with a water-ink in a direct liquid-writing instrument, the composition containing: 20 to 95% by mass of (A) a polyamide-based resin; and 80 to 5% by mass of (B) at least one resin selected from a styrene-based resin, an olefin-based resin and a polyphenylene ether resin.

The present invention provides a direct liquid-writing instrument using a water-ink, wherein a part contacting with the water-ink in the direct liquid-writing instrument contains a resin composition containing: 20 to 95% by mass of (A) a polyamide-based resin; and 80 to 5% by mass of (B) at least one resin selected from a styrene-based resin, an olefin-based resin and a polyphenylene ether resin.

The present invention provides a direct liquid-writing instrument having an ink-retaining part wherein an ink is retained and a pen-tip, at least a part or surface contacting with a water-ink of the ink-retaining part containing (A) 20 to 95% by mass of a polyamide-based resin and 80 to 5% by mass of (B) at least one resin selected from a styrene-based resin, an olefin-based resin and a polyphenylene ether resin.

The present invention provides a direct liquid-writing instrument, as shown above, in which a water-ink is retained in the ink-retaining part.

The present invention provides use of the above-mentioned resin composition for a part contacting with a water-ink in a direct liquid-writing instrument.

The direct liquid-writing instrument of the invention can be used with ink flowing from the ink retainer directly to, for example, paper.

Figure 1:
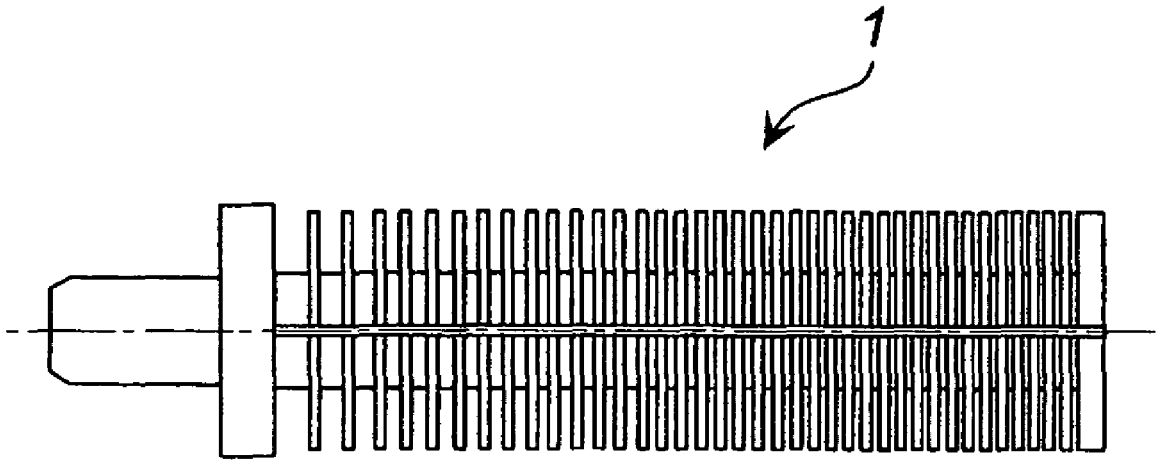
FIG. 1 shows a front view of the ink-retaining part in a bellows-like shape, made of the resin composition of the present invention.

In the Figures, numerical reference 1 means the ink-retaining part and 10 means the ballpoint pen using a water-ink (direct liquid-writing instrument).

DETAILED DESCRIPTION OF THE INVENTION

The resin composition according to the present invention provides a good wettability to a molded article being manufactured therefrom. As a result, the part contacting with a water-ink, manufactured from the resin composition (preferably an ink-retaining part in a bellows-like shape), has an improved wettability without applying a wettability-improving treatment such as an etching treatment which is adopted in conventional technologies. Consequently, the direct liquid-writing instrument having the part does not need the wettability-improving treatment such as an etching treatment during the manufacturing process, and the occurrence of ink-leakage from the pen-tip is significantly suppressed even after a long period of use.

<Resin Composition for a Part Contacting with a Water-Ink, in a Direct Liquid-Writing Instrument>

The resin composition according to the present invention is used for the part contacting with a water-ink in the direct liquid-writing instrument. The resin composition of the present invention is preferably at least for an ink-retaining part in a bellows-like shape.

The "ink-retaining part in a bellows-like shape" which is manufactured from the resin composition of the present invention is a known part in direct liquid-writing instruments using a water-ink. The "ink-retaining part in a bellows-like shape" is, for example, an ink-retaining part 1 shown in FIG. 1, and which is the same as the "ink-retaining member 2" in JP-A 8-156481, the "ink-retaining portion 14b" in JP-A 9-315079, and the "collector (ink-retaining body) 2b" in JP-A 11-268470.

((A) Component)

Examples of the polyamide-based resin of the component (A) are: nylon 66, polyhexamethylene sebacanamide (nylon 6•10), polyhexamethylene dodecanamide (nylon 6•12), polydodecamethylene dodecanamide (nylon 1212), polymethaxylylene adipamide (nylon MXD6), polytetramethylene adipamide (nylon 46), and a mixture or a copolymer of them; a copolymer such as nylon 6/66, nylon 66/6T (6T:polyhexamethylene terephthalamide) having 50% by mole or less of 6T component, nylon 66/6I (6I:polyhexamethylene isophthalamide) having 50% or less of 6I component, nylon 6T/6I/66, or nylon 6T/6I/610; and a copolymer such as polyhexamethylene terephthalamide (nylon 6T), polyhexamethylene isophtalamide (nylon 6I), poly(2-methylpentamethylene)

terephthalamide (nylon M5T), poly(2-methylpentamethylene)isophthalamide (nylon M5I), nylon 6T/6I, or nylon 6T/M5T. Other than the above, there are applicable a copolymerized nylon such as amorphous nylon. The amorphous nylon includes a polycondensate of terephthalic acid and trimethylhexamethylene diamine.

Furthermore, there are applicable a ring-opened polymer of cyclic lactam, a polycondensate of an aminocarboxylic acid, and a copolymer of these components, specifically an aliphatic polyamide resin such as nylon 6, poly-ω-undecanamide (nylon 11), or poly-ω-dodecanamide (nylon 12), and a copolymer of them, a copolymer with a polyamide composed of diamine and dicarboxylic acid, specifically nylon 6T/6, nylon 6T/11, nylon 6T/12, nylon 6T/6I/12, nylon 6T/6I/610/12, and the like, and a mixture of them.

As for the polyamide-based resin, PA (nylon) 6, PA (nylon) 66, and PA (nylon) 6/66 are preferred in the above group.

((B) Component)

The (B) component is at least one resin selected from the group consisting of a styrene-based resin, an olefin-based resin, and a polyphenylene ether resin.

Applicable styrene-based resins include a polymer of styrene and styrene-derivatives such as α-substituted styrene and a nucleus-substituted styrene. Also there are included a copolymer composed of the above monomers as the main components and of a monomer of a vinyl compound such as acrylonitrile, acrylic acid, and methacrylic acid and/or of a monomer of a conjugated diene such as butadiene and isoprene. Examples of them are polystyrene, high-impact polystyrene (HIPS) resin, acrylonitrile-butadiene-styrene copolymer (ABS) resin, acrylonitrile-styrene copolymer (AS resin), styrene-methacrylate copolymer (MS resin), and styrene-butadiene copolymer (SBS resin).

The polystyrene-based resin may contain a styrene-based copolymer prepared by copolymerization with a carboxyl group-containing unsaturated compound to improve the compatibility and the reactivity with the polyamide-based resin. The styrene-based copolymer prepared by copolymerization with a carboxyl group-containing unsaturated compound is a copolymer prepared by polymerization of a carboxyl group-containing unsaturated compound and, if needed, another monomer copolymerizable therewith in the presence of a rubber-like polymer.

Examples of the components are the following:

(1) A graft polymer prepared by polymerization of a monomer containing an aromatic vinyl monomer as the essential component, or a monomer containing an aromatic vinyl compound and a carboxyl group-containing unsaturated compound as the essential components, in the presence of a rubber-like polymer prepared by copolymerization of a carboxyl group-containing unsaturated compound;

(2) A graft copolymer prepared by copolymerization of a monomer containing an aromatic vinyl compound and a carboxyl group-containing unsaturated compound as the essential components, in the presence of a rubber-like polymer;

(3) A mixture of a rubber-reinforced styrene-based resin, in which the carboxyl group-containing unsaturated compound is not copolymerized, and a copolymer composed of monomer containing a carboxyl group-containing unsaturated compound and an aromatic vinyl compound as the essential components;

(4) A mixture of the above (1), (2) and a copolymer containing a carboxyl group-containing unsaturated compound and an aromatic vinyl compound as the essential components; and (5) A mixture of the above (1) to (4), and a copolymer containing an aromatic vinyl compound as the essential components.

As of the above (1) to (5), the aromatic vinyl compound is preferably styrene and the monomer copolymerizing with the aromatic vinyl compound prefers acrylonitrile.

The content of the carboxyl group-containing unsaturated compound in the styrene-based resin is preferably within a range of 10 to 50% by mass.

The olefin-based resin is a polymer containing a monoolefin of carbon numbers 2 to 8 as the major monomer component. Examples of the olefin-based resin are low-density polyethylene, high-density polyethylene, linear low-density polyethylene, polypropylene, ethylene-propylene random copolymer, ethylene-propylene block copolymer, polymethylpentene, polybutene-1, and one or more of modified compounds or the like of them.

((C) Component)

In addition to the above components (A) and (B), the resin composition according to the present invention may further contain a polymer having a maleimide-based monomer unit of the component (C) as the component functioning as a compatibilization agent for these resins. The polymer having a maleimide-based monomer unit of the component (C) may be a polymer having a maleimide-based monomer unit or may be a copolymer of maleimide-based monomer unit and another monomer unit.

Preferred maleimide-based monomers as the maleimide-based monomer unit are one or more compounds selected from maleimide, N-methyl maleimide, N-ethyl maleimide, N-propyl maleimide, N-isopropyl maleimide, N-cyclohexyl maleimide, N-phenyl maleimide, N-toluyl maleimide, N-xylyl maleimide, N-naphthyl maleimide, N-t-butyl maleimide, N-ortochlorophenyl maleimide and N-orthomethoxyphenyl maleimide.

The monomer having other monomer units includes: aromatic vinyl-based compounds such as styrene, a-methyl styrene, vinyl ketone, or t-butyl styrene; and unsaturated dicaroboxylic acid anhydrides such as maleic anhydride, methyl maleic anhydride, 1,2-dimethyl maleic anhydride, ethyl maleic anhydride, or phenyl maleic anhydride.

The polymer having a maleimide-based monomer unit prefers a copolymer composed of a maleimide-based monomer, an aromatic vinyl monomer, and an unsaturated dicarboxylic acid anhydride monomer. When these three kinds of monomers are combined, the mixing ratio is preferably within a range given below.

The content of the maleimide-based monomer unit is preferably within a range of 10 to 80% by mass, more preferably 30 to 60% by mass, and most preferably 40 to 55% by mass. The content of the aromatic vinyl-based monomer unit is preferably within a range of 10 to 80% by mass, more preferably 30 to 60% by mass, and most preferably 40 to 55% by mass. The content of the unsaturated dicarboxylic acid anhydride monomer unit is preferably within a range of 0.1 to 10% by mass, more preferably 0.5 to 5% by mass, and most preferably 0.5 to 3% by mass.

When, as the component (B), a styrene-based copolymer prepared by copolymerization of a carboxyl group-containing unsaturated compound is adopted to improve the compatibility and the reactivity with the polyamide-based resin, the component (C) may be used in combination with the styrene-based copolymer or may be used instead of the styrene-based copolymer.

In the resin composition according to the present invention, the content of the component (A) is within a range of 20 to 95% by mass, preferably 40 to 90% by mass, more preferably 45 to 80% by mass, and most preferably 50 to 75% by mass, and the content of the component (B) is within a range of 80 to 5% by mass, preferably 60 to 10% by mass, more preferably 55 to 20% by mass, and most preferably 50 to 25% by mass.

When the resin composition according to the present invention further contains a polymer having the maleimide-based monomer unit of the component (C), the content of the component (C) is preferably within a range of 1 to 50 parts by mass to 100 parts by mass of the sum of components (A) and (B), more preferably 3 to 30 parts by mass, and most preferably 5 to 15 parts by mass.

The resin composition according to the present invention can further contain varieties of publicly known additives other than the above components (A), (B) and (C), within the range of being able to solve the above issues. Publicly known additives include a plasticizer, heat or light stabilizer, processing aid, antioxidant, coloring matter such as a pigment, fibrous or powdery filler, and the like.

<Direct Liquid-Writing Instrument>

The direct liquid-writing instrument according to the present invention has a part, made of the above-described resin composition, contacting with a water-ink. To solve the issues of the present invention, the part is preferably at least the above-described ink-retaining part in a bellows-like shape.

Figure 2:
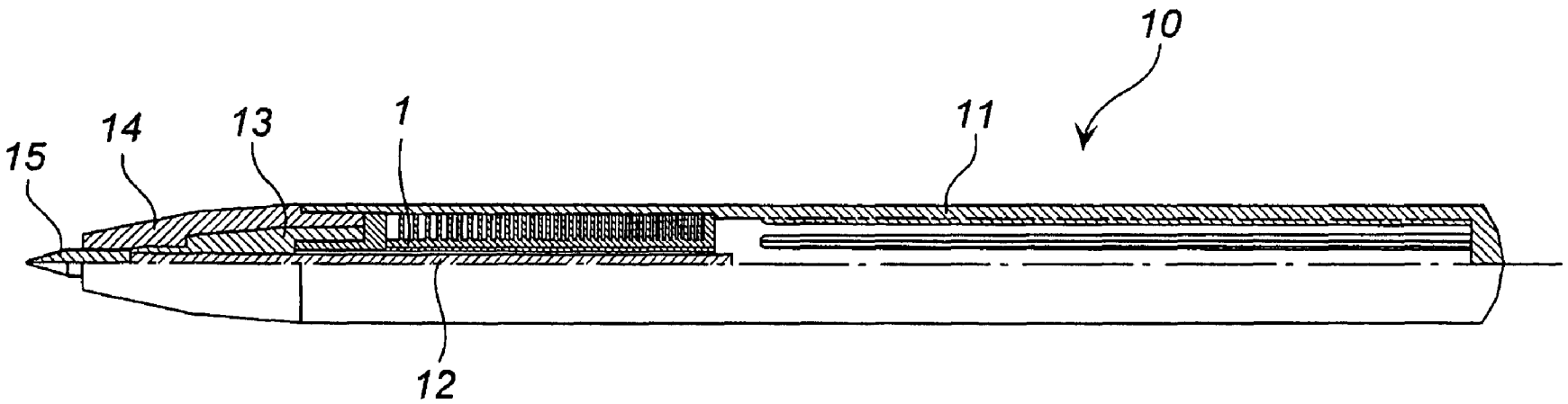
FIG. 2 shows a part-cross sectional view (in the axial direction) of the direct liquid-writing instrument according to the present invention.

The direct liquid-writing instrument according to the present invention can be, for example, a ballpoint pen 10 shown in FIG. 2. The ink-retaining part 1 of the present invention is incorporated in a main body 11 of the ballpoint pen 10. The reference number 12 indicates inner cotton, the number 13 indicates joint part, the number 14 indicates taper part, and the number 15 indicates tip. The water-ink is contained in contact with the ink-retaining part 1.

The liquid-flow-type writing instrument according to the present invention uses a water-ink or an aqueous ink. The water-ink includes water and a dye or pigment. It may further include a surfactant. The used ink may be black or in color.

A preferred surface tension of the water-ink is in a range from 30 to 50 dyne/cm. Around 40 dyne/cm is more preferred. One example of commercially available blue inks has a surface tension of 34.3 mN/m or 34.3 dyne/cm. One example of commercially available black inks has a surface tension of 38.6 mN/m or 38.6 dyne/cm.

The water-ink having a preferable surface tension has a good wettability to an ink-retaining part, and makes it possible to make a clear record with a dried ink without running to a record material such as a paper.

The above-mentioned water-ink having a preferable surface tension has a good wettability to the ink-retaining part obtained from the resin composition of the present invention. Accordingly, in the present invention, the wettabilty can be improved without applying any wettability-improving treatment such as etching treatment which is adopted in conventional technologies.

The water-ink of the present invention may include a small amount of an organic solvent mainly for adjusting the surface tension.

The water-ink used in the direct liquid-writing instrument according to the present invention may be a known one. It may contain water as the base component, a coloring matter and, optionally, other components. In general, it has a surface tension of around 40 dyn/cm as above shown.

As the coloring matter, a dye such as an acidic dye, a direct dye or a basic dye, an organic pigment such as an azo pigment, a nitroso pigment, a nitro pigment, a basic dye pigment, an acidic dye pigment, a vat dye pigment, a mordant color pigment or a natural dye pigment, ocher, barium yellow, iron blue, barium sulfate, titanium oxide, red oxide, iron black, or carbon black may be used.

As the other component, a viscosity modifier including, for example, polyvinyl pyrrolidone, polyacrylic acid or a poly saccharide such as a cellulose derivative such as hydroxypropyl cellulose or carboxymethyl cellulose, gur gum, xantan gum or hyaluronan; a surfactant; a water-soluble organic solvent such as ethanol, propanol, isopropanol, ethylene glycol, propylene glycol, 1,3-butylene glycol, diethylene glycol, triethylene glycol or glycerin; and a reducing compound such as an anticorrosive agent, an antibacterial and antifungal agent, ascorbic acid, kojic acid or a polyphenol such as hydroquinone, resorcin, catechol, pyrogallol, tannic acid or gallic acid may be used.

When a pigment is used as a colorant, a dispersant may be used for dispersing the pigment stably, such as a water-soluble resin a styrene acrylic salt or a styrene maleic salt, another water-soluble resin or an anionic or nonionic surfactant.

Regarding the direct liquid-writing instrument according to the present invention, since the part contacting with a water-ink (preferably an ink-retaining part in a bellows-like shape) is made of a resin composition containing the above components (A) and (B) and further, if needed, the component (C) and the like, an adequate wettability can be achieved. Consequently, in this instance, it never happens that the wettability becomes excessively high and the supply of ink becomes poor as is the case for an ink-contacting part made of sole component (A) or, by contrast, the wettability becomes excessively low and ink leakage is caused as is the case for an ink-contacting part made of sole component (B).

The part contacting with a water-ink may be formed preferably into an ink collector, a bellows-like shape, an accordion shape or a retainer having a row of baffle plates closely arranged. It works to regulate the ink flow into the pen tip to prevent too much of an amount of flow and too small of an amount of flow.

The direct liquid-writing instrument according to the present invention is applicable to ballpoint pens, fountain pens, and the like using a water-ink, currently available in the market.

EXAMPLES

Examples of the present invention given below are for carrying out the present invention, although the Examples provided here should not be construed as limiting the invention.

Examples and Comparative Examples

The components shown in Table 1 were mixed in a V-shape tumbler for the Examples and Comparative Examples, respectively, and then were melt-kneaded in a twin screw extruder (230° C. of cylinder temperature, TEX 30, manufactured by The Japan Steel Works Ltd.), thus obtaining the pellets of the respective resin compositions.

Next, using an injection molding machine (240° C. cylinder temperature and 60° C. mold temperature), the ink-retaining part 1 in a bellows-like shape shown in FIG. 1 was molded by injection molding. The thus prepared ink-retaining part 1 in a bellows-like shape was attached to the ballpoint pen 10 having the structure of FIG. 2. A heat-cycle test was conducted under the following condition to evaluate the presence/absence of ink leakage from the pen-tip. The used water-ink contained 80% by mass of water, 19.9% by mass of a dye and 0.1% by mass of a nonionic surfactant, having a viscosity at 25° C. of 2.1 mPa·s, a surface tension of 40.2 dyn/cm and a pH value of around 7.

(Heat Cycle Test Condition)

For each example, 200 ballpoint pens were prepared. The single heat cycle was defined as: 20° C. (5 min)→temperature drop (30 min)→−10° C. (5 min)→temperature rise (90 min)→60° C. (5 min)→temperature drop (10 min)→20° C.: (Total 145 min). After 36 cycles for each ballpoint pen, the number of ballpoint pens which caused ink leakage from the pen-tip was counted. The result showed that the smaller the number of ballpoint pens which caused the ink leakage becomes, the greater the wettability of the ink-retaining part in a bellows-like shape.

TABLE 1

| | Example | | | | | Comparative Example | |
|---|---|---|---|---|---|---|---|
| | 1 | 2 | 3 | 4 | 5 | 1 | 2 |
| (A) Polyamide 6 | 30 | 50 | 60 | 70 | 60 | — | — |
| (B) ABS resin | 30 | 20 | 10 | 10 | 20 | 70 | 70 |
| (B) AS resin | 30 | 20 | 20 | 15 | 10 | 30 | 30 |
| (B) Acid-modified ABS resin | 10 | 10 | 10 | 5 | | — | — |
| (C) Polymer having maleimide-based monomer unit | — | — | — | — | 10 | — | — |
| Etching treatment by chromic acid | Not applied | Not applied | Not applied | Not applied | Not applied | Not applied | Applied |
| The number of ballpoint pens causing ink leakage/200 ballpoint pens | 2 | 0 | 0 | 0 | 0 | 100 | 5 |

After the completion of the heat cycle test, ten pens were arbitrarily sampled from the ballpoint pens described in the respective examples. The sampled ballpoint pens were tested for writing, and all of them wrote well.

Polyamide 6: UBE Nylon 6 1013B, manufactured by Ube Industries, Ltd.

ABS resin: Styrene 45% by mass, Acrylonitrile 15% by mass, Polybutadiene 40% by mass AS resin: Styrene 75% by mass, Acrylonitrile 25% by mass Maleic anhydride-modified ABS resin: Styrene 42% by mass, Acrylonitrile 16% by mass, Butadiene-based rubber 40% by mass and maleic anhydride 2% by mass Polymer containing maleimide-based monomer unit: Styrene-N-phenylmaleimide-maleic anhydride copolymer (Styrene 47% by mass, N-phenylmaleimide 51% by mass, Maleic anhydride 2% by mass, Weight average molecular weight: 145,000, Melt flow index at 265° C. and 10 kg:2)

What is claimed is:

1. A direct liquid-writing instrument comprising an ink-retaining part where a water-ink is retained and a pen-tip, at least a part of the ink-retaining part in contact with the water-ink having a bellows-like shape and comprising (A) 20 to 95% by mass of a polyamide-based resin and 80 to 5% by mass of (B) at least one resin selected from the group consisting of a styrene-based resin, an olefin-based resin and a polyphenylene ether resin.

2. The writing instrument according to claim 1, wherein the component (A) content is within a range of 45 to 80% by mass, and the component (B) content is within a range of 55 to 20% by mass.

3. A direct liquid-writing instrument comprising an ink-retaining part where a water-ink is retained and a pen tip, at least a part of the ink-retaining part in contact with the water-ink comprising (A) 20 to 95% by mass of a polyamide-based resin, 80 to 5% by mass of (B) at least one resin selected from the group consisting of a styrene-based resin, an olefin-based resin and a polyphenylene ether resin and (C) a polymer having a maleimide-based monomer unit.

4. The writing instrument according to claim 3, wherein the part contacting with said water-ink has a bellows-like shape.

5. The writing instrument according to claim 3, wherein the component (A) content is within a range of 45 to 80% by mass and the component (B) content is within a range of 55 to 20% by mass.

6. The writing instrument according to claim 3, wherein the content of the maleimide-based monomer unit in the polymer is in the range of 10 to 80% by mass.

7. The writing instrument according to claim 3, wherein the content of component (C) is within a range of 5 to 15 parts by mass to 100 parts by mass of the sum of components (A) and (B).

* * * * *